US008506009B2

(12) United States Patent
LaPointe et al.

(10) Patent No.: US 8,506,009 B2
(45) Date of Patent: Aug. 13, 2013

(54) POWER ACTUATED WALL PROXIMITY FURNITURE MEMBER

(75) Inventors: Larry P. LaPointe, Temperance, MI (US); Chad E. Adams, Perrysburg, OH (US); Eric B. Harwood, Toledo, OH (US); Richard E. Marshall, Monroe, MI (US); Michael R. Mero, Jr., Monroe, MI (US)

(73) Assignee: La-Z-Boy Incorporated, Monroe, MI (US)

( * ) Notice: Subject to any disclaimer, the term of this patent is extended or adjusted under 35 U.S.C. 154(b) by 373 days.

(21) Appl. No.: 12/759,250

(22) Filed: Apr. 13, 2010

(65) Prior Publication Data

US 2011/0248545 A1 Oct. 13, 2011

(51) Int. Cl.
*A47C 1/31* (2006.01)

(52) U.S. Cl.
USPC ..... 297/85 M; 297/85 R; 297/362.11

(58) Field of Classification Search
USPC ..... 297/85 M, 85 R, 362.11
See application file for complete search history.

(56) References Cited

U.S. PATENT DOCUMENTS

| | | | | |
|---|---|---|---|---|
| 426,602 | A | 4/1890 | Muhl | |
| 3,357,739 | A | 12/1967 | Knabusch et al. | |
| 3,858,932 | A | 1/1975 | Crum et al. | |
| 4,153,292 | A | 5/1979 | White et al. | |
| 4,154,475 | A | 5/1979 | Shoemaker et al. | |
| 4,307,912 | A | 12/1981 | Watt et al. | |
| 4,367,895 | A | 1/1983 | Pacitti et al. | |
| 5,141,284 | A | 8/1992 | LaPointe | |
| 5,423,591 | A | 6/1995 | LaPointe et al. | |
| 5,427,431 | A | 6/1995 | Saul et al. | |
| 5,480,209 | A | 1/1996 | May | |
| 5,570,927 | A | 11/1996 | LaPointe et al. | |
| 5,651,580 | A * | 7/1997 | LaPointe et al. | 297/85 M |
| 5,992,930 | A | 11/1999 | LaPointe et al. | |
| 5,992,931 | A | 11/1999 | LaPointe et al. | |
| 6,000,758 | A | 12/1999 | Schaffner et al. | |
| 6,135,559 | A * | 10/2000 | Kowalski | 297/354.12 |
| 6,145,924 | A | 11/2000 | Mero, Jr. et al. | |
| 6,231,120 | B1 | 5/2001 | Wiecek | |
| 6,557,934 | B2 | 5/2003 | Wiecek | |
| 6,655,732 | B1 | 12/2003 | LaPointe | |
| 6,945,599 | B2 | 9/2005 | May | |
| 7,722,114 | B2 * | 5/2010 | Smith | 297/68 |

(Continued)

OTHER PUBLICATIONS

International Search Report for International Application No. PCT/US2011/029561 mailed Jan. 2, 2012.

(Continued)

*Primary Examiner* — David Dunn
*Assistant Examiner* — Tania Abraham
(74) *Attorney, Agent, or Firm* — Harness, Dickey & Pierce, P.L.C.

(57) ABSTRACT

An electrically operated wall proximity furniture member includes a frame and an actuation mechanism rotatably connected to the frame. The actuation mechanism includes first and second independently rotatable seat back support members oriented to face a wall outer surface. An electrically powered drive assembly operates to rotate the seat back member between fully upright and fully reclined positions inclusive. A point of the seat back support members when positioned in the fully upright position defines a rear-most extent of the actuation mechanism. The rear-most extent defines a vertical plane having no portion of the actuation mechanism extending beyond the rear-most extent toward the wall outer surface during any operation of the actuation mechanism.

14 Claims, 9 Drawing Sheets

(56) References Cited

U.S. PATENT DOCUMENTS

| | | | | |
|---|---|---|---|---|
| 2003/0047973 | A1 | 3/2003 | Pellerin | |
| 2005/0017561 | A1 | 1/2005 | Burmeister, III et al. | |
| 2006/0087159 | A1* | 4/2006 | Sheldon et al. | 297/30 |
| 2009/0256402 | A1* | 10/2009 | Smith | 297/69 |

OTHER PUBLICATIONS

Written Opinion of the International Searching Authority for International Application No. PCT/US2011/029561 mailed Jan. 2, 2012.

* cited by examiner

POWER ACTUATED WALL PROXIMITY FURNITURE MEMBER

FIELD

The present disclosure relates to furniture members having leg rest assemblies capable of extension or retraction as well as seat back members that can rotate, where leg rest or seat back member movement does not result in contact between the furniture member and a proximate wall.

BACKGROUND

This section provides background information related to the present disclosure which is not necessarily prior art.

Conventionally, reclining articles of furniture (i.e., chairs, sofas, loveseats, and the like) require a mechanism to bias a leg rest assembly in the extended and stowed positions and to move a seat back member from an upright to a fully reclined position. Most reclining furniture members include an upholstered frame supported from a stationary base assembly. For example, known combination platform reclining chairs permit reclining movement of the seat assembly and actuation of the leg rest assembly independently of the seat back member. The leg rest assembly is operably coupled to a drive mechanism to permit the seat occupant to selectively move the leg rest assembly between its normally retracted (i.e., "stowed") and elevated (i.e., "extended") positions. The drive mechanism is manually-operated and includes a handle which, when rotated by the seat occupant, causes concurrent rotation of a drive rod for extending or retracting the leg rest assembly.

Known mechanisms provide for clearance to a nearby wall with the seat back member in the upright position; however, they do not limit a rearward displacement of the seat back member during motion toward the fully reclined position and, therefore, the seat back member can contact the wall when fully reclined. Manually actuated mechanisms are known that can limit a rearward displacement of the seat back member between the upright and fully reclined positions, which permits the furniture member to be positioned in close proximity to a wall without the seat back member contacting the wall in any operating position of the furniture member. These furniture members are known as "wall proximity" furniture members.

SUMMARY

This section provides a general summary of the disclosure, and is not a comprehensive disclosure of its full scope or all of its features.

According to several embodiments of the present disclosure, an electrically operated wall proximity furniture member includes a frame. An actuation mechanism connected to the frame includes at least one rotatable seat back support member and an electrically powered drive assembly operating to rotate the seat back support member between fully upright and fully reclined positions inclusive. A link displaces the seat back support member between the fully upright and fully reclined positions inclusive with the seat back support member moved substantially forward from the fully upright position to the fully reclined position such that the fully upright position defines a rear-most extent of the seat back support member.

According to further embodiments, an electrically operated wall proximity furniture member includes a frame and an actuation mechanism rotatably connected to the frame. The actuation mechanism includes first and second rotatable seat back support members and an electrically powered drive assembly operating to rotate the seat back support members between fully upright and fully reclined positions inclusive. A point of each of the seat back support members when positioned in the fully upright position defines a rear-most extent of the seat back support members between each of the fully upright and fully reclined positions.

According to other embodiments, an electrically operated wall proximity furniture member includes a frame and an actuation mechanism rotatably connected to the frame. The actuation mechanism includes an extendable and retractable leg rest assembly and first and second rotatable seat back support members oriented to face a wall outer surface. An electrically powered drive assembly operates to move the leg rest assembly between retracted and extended positions inclusive and to further rotate the seat back member between fully upright and fully reclined positions inclusive. A point of the seat back support members when positioned in the fully upright position is positioned at a rear-most extent of the seat back support members. The rear-most extent defines a vertical plane spaced from the wall outer surface having no portion of the seat back support members extending beyond the vertical plane and closer to the wall outer surface than the vertical plane when the seat back support member is repositioned to the fully reclined position.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
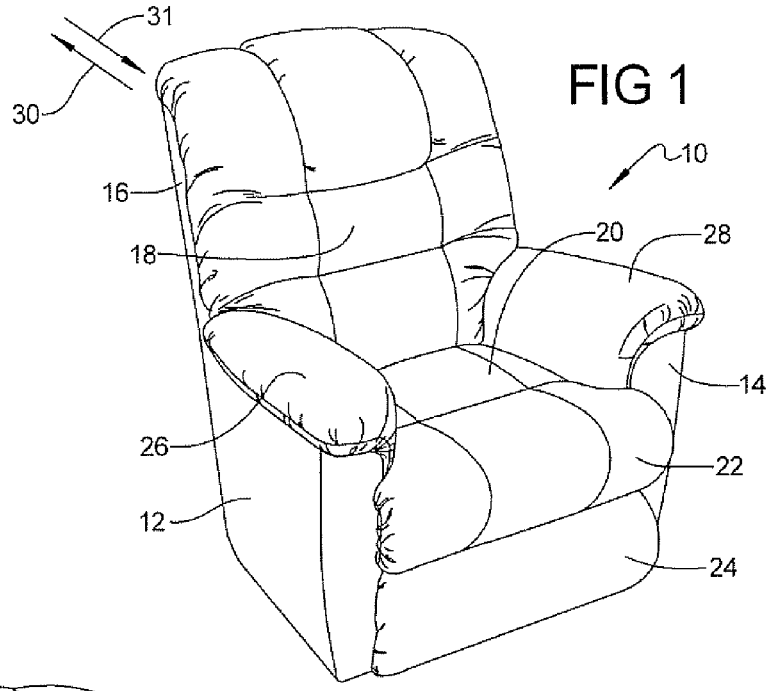
FIG. 1 is a front right perspective view of a power actuated wall proximity furniture member of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and, therefore, specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Figure 10:
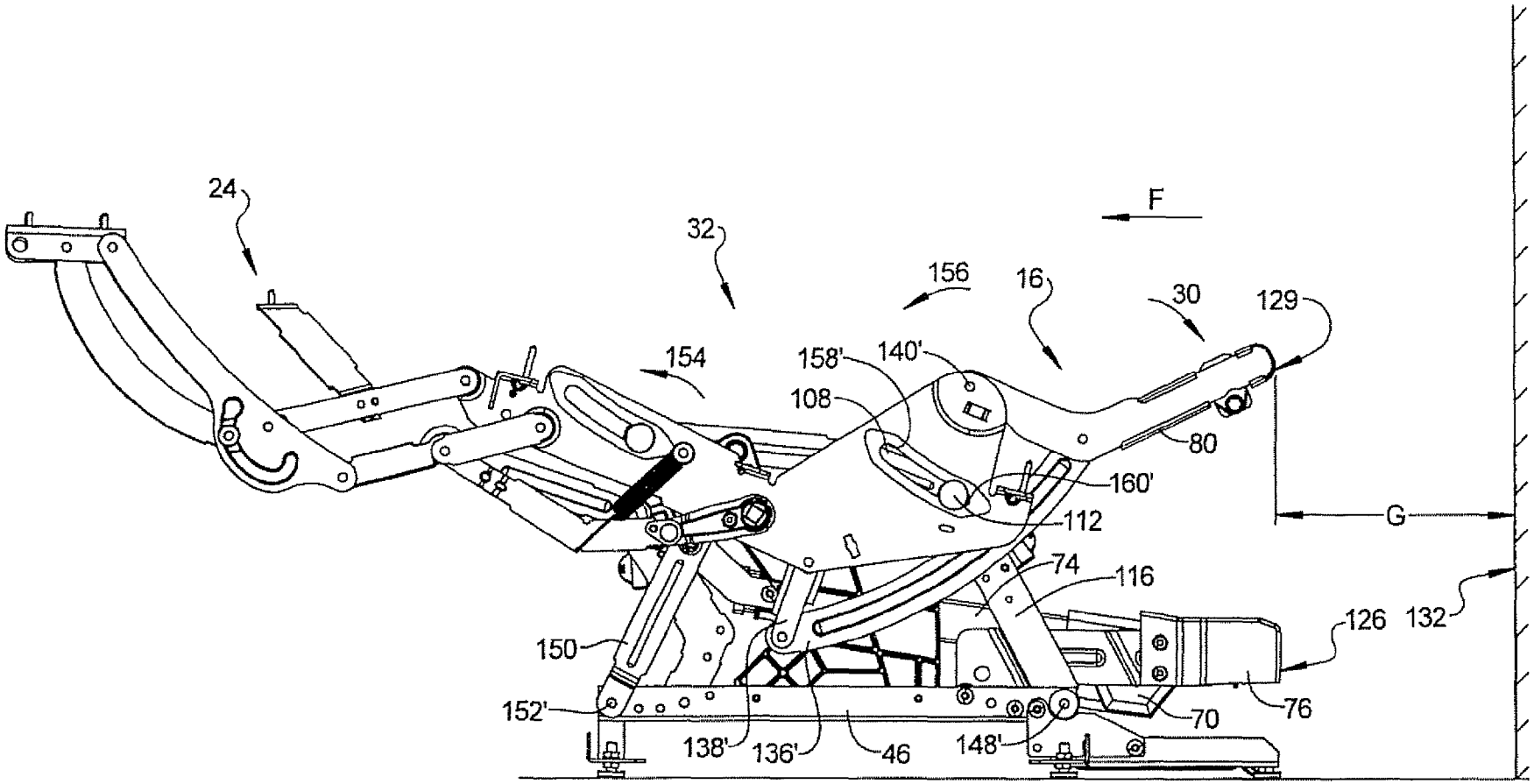
FIG. 10 is a left side elevational view of the actuation mechanism of FIG. 3 further showing the leg rest assembly in the fully extended position and the seat back member in a fully reclined position.

Referring generally to FIG. 1, a furniture member 10 depicted as a reclining chair includes first and second sides 12, 14 and an occupant seat back 16 covered with a seat back cushion assembly 18. An occupant support member 20 is suspended between the first and second sides 12, 14 and a padded leg support 22 is also provided. A padded, extendable leg rest assembly 24 is also provided. First and second arm rest pads 26, 28 can be used to cover the upper surfaces of the first and second sides 12, 14 respectively. An occupant's weight generally centered on support member 20 is normally operable to maintain seat back 16 in an upright position. When the leg rest assembly 24 is positioned in a stowed or retracted position shown, seat back 16 cannot be manually reclined or rotated with respect to a seat back arc of rotation 30. Seat back 16 rotates about a seat back reclining arc of rotation 30 only after leg rest assembly 24 reaches a fully extended position shown and described with reference to FIGS. 6 and 10. Seat back 16 is rotated by electrical power to return to the upright position shown about a seat back forward arc of rotation 31, oppositely directed with respect to seat back reclining arc of rotation 30 when desired by the occupant to return leg rest assembly 24 from a fully extended position to the fully retracted position. In the embodiment shown, furniture member 10 is depicted as a chair however the present teachings are not limited to chairs. Furniture member 10 can also be any of a plurality of furniture members, including, but not limited to single or multiple person furniture members, sofas, sectional members and/or loveseats.

Figure 2:
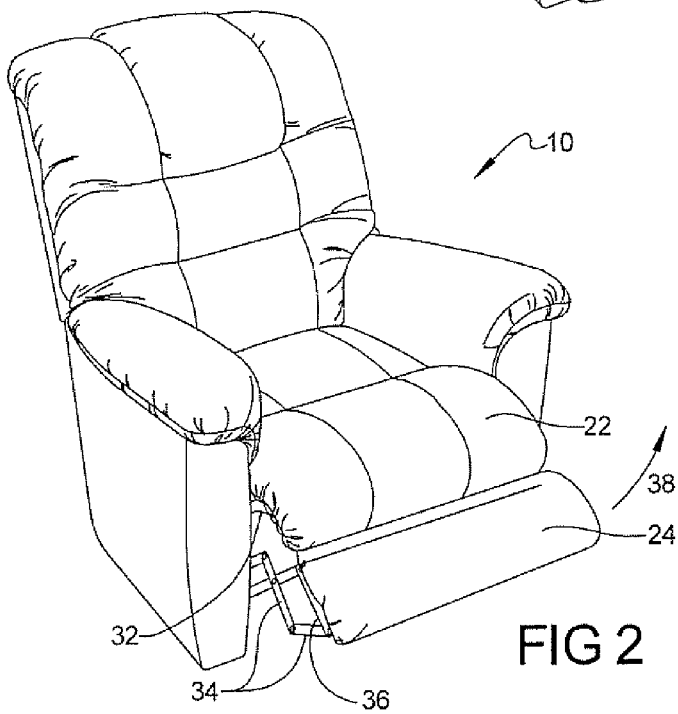
FIG. 2 is a front right perspective of the furniture member of FIG. 1 further showing a leg rest assembly in an extended position.

Referring generally to FIG. 2 and again to FIG. 1, an actuation mechanism 32 (shown only partially in this view) can be automatically actuated by command from the occupant to direct the repositioning of leg rest assembly 24 from the stowed position (shown in FIG. 1) to an extended position. Actuation mechanism 32 supports and permits both extension and retraction of leg rest assembly 24, as well as rotation of seat back 16. More specifically, actuation mechanism 32 includes first and second pantograph linkage sets 34, 35 (second pantograph linkage set 35 is not visible in this view) which are linked to leg rest assembly 24 using first and second leg rest support arms 36, 37 (only first leg rest support arm 36 is visible in this view). Leg rest assembly 24 can be moved from the fully retracted position (shown in FIG. 1) to an extended position by motion of the leg rest assembly 24 about a leg rest extension arc 38. It will be apparent that rotation of leg rest assembly 24 in an opposite direction from extension arc 38 will return the leg rest assembly 24 to the retracted position.

Figure 3:
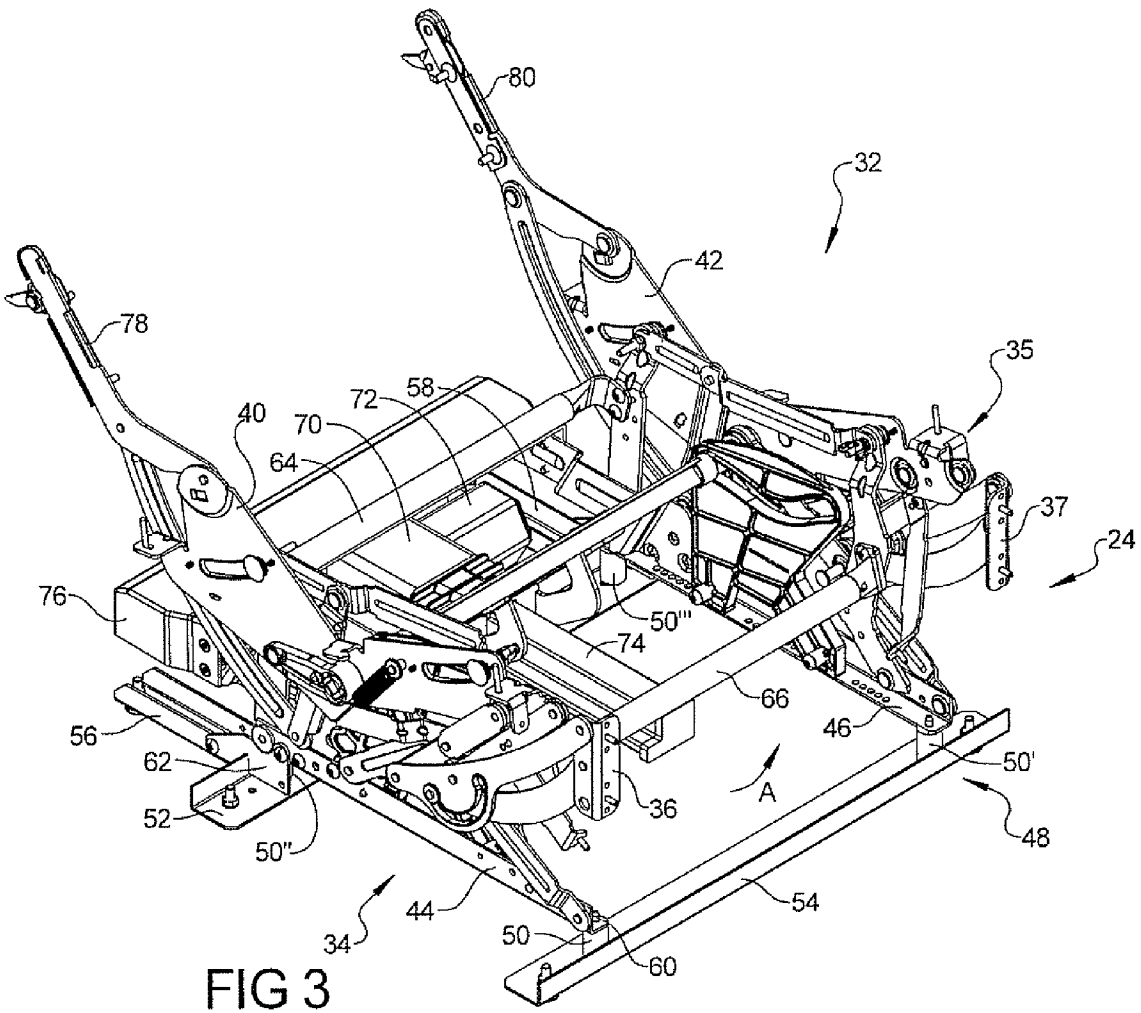
FIG. 3 is a front right perspective view of a actuation mechanism for the furniture member of FIG. 1.

Referring to FIG. 3, the functional and structural aspects of actuation mechanism 32 for use in either single or multi-person furniture members 10 is shown. For purposes of clarity, FIG. 3 shows the various pre-assembled frame components with their upholstery, padding, etc. removed to better illustrate the interdependency of the mechanism components' construction which can be rapidly and efficiently assembled. Therefore, all of the mechanism components can be individually fabricated or sub-assembled to include the requisite brackets, springs, padding and upholstery on an "off-line" batch-type basis. Thereafter, the various pre-assembled and upholstered furniture components are assembled for totally integrating actuation mechanism 32 therein.

As generally used herein, the terms front or forward and right hand or left hand are oriented with respect to the direction an occupant of the furniture member 10 faces when seated or with respect to the occupant's sides when the occupant is seated. The terms rear or rearward refer to a direction opposite to the front or forward direction. The linkage portion of actuation mechanism 32 includes right and left side assemblies 40, 42, which are rotatably connected to and supported on right and left side support members 44, 46. Right and left side support members 44, 46 are connected to a frame support structure such as a frame 48 using a plurality of substantially vertically oriented, tubular-shaped elastic support elements 50, 50', 50", 50'" such that right and left side support members 44, 46 and right and left side assemblies 40, 42 can collectively deflect within an elastic deformation range of elastic support elements 50, 50', 50", 50'" with respect to frame 48.

Frame 48 can also include rear and front cross members 52, 54 are provided to space and provide structural rigidity of right and left side assemblies 40, 42 and right and left frame extensions 56, 58. Occupant loads at a front portion of furniture member 10 are transferred from right and left side support members 44, 46 to front cross frame member 54 which is connected such as by fasteners 60 (which can be bolts, threaded fasteners, extension rivets, or the like) extending through through-apertures of elastic support elements 50, 50'. Similarly, occupant loads at a rear portion of furniture member 10 are transferred from right and left side support members 44, 46 to rear cross frame member 52 which is connected such as by fasteners 60 extending through through-apertures of elastic support elements 50", 50'" (not clearly visible in this view). Right and left frame extensions 56, 58 are connected to rear cross frame member 52 by threaded fasteners or rivets (not visible in this view) and by brackets 62, 62' (only right side bracket 62 is visible in this view). In some embodiments the frame members of frame support structure 48 can be created from formed, bent and/or extruded angle elements, of metal such as steel or aluminum, or of polymeric or composite materials. The present disclosure is not limited by the material used for the frame components.

Figure 4:
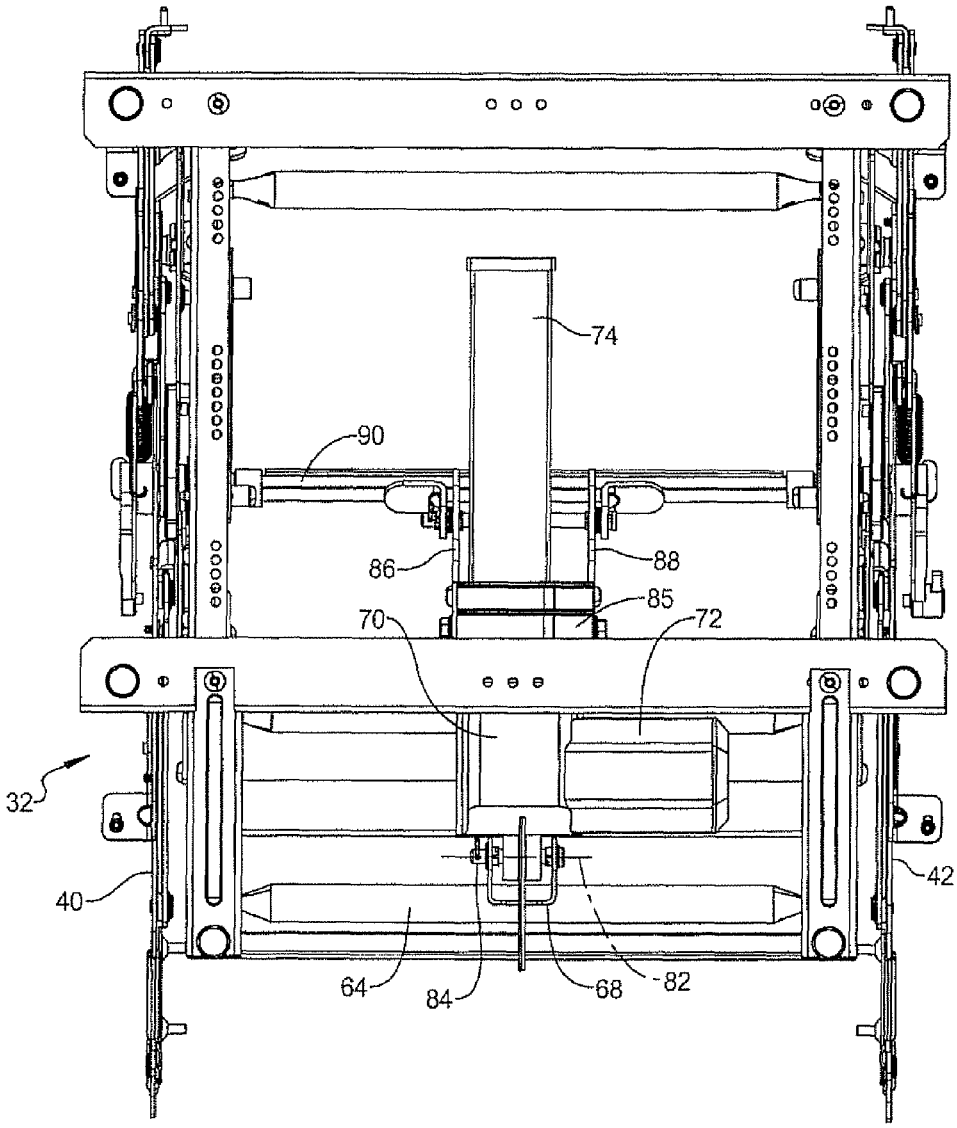
FIG. 4 is a bottom plan view of the actuation mechanism of FIG. 3.

A rear cross brace 64 and a front cross brace 66 connect right and left side assemblies 40, 42. A hinge pin assembly 68 (shown and described in greater detail in reference to FIG. 4) connected to rear cross brace 64 rotatably supports an electrically powered and occupant controlled drive assembly 70. A motor 72 such as an AC or DC electric motor is connected to drive assembly 70 to provide powered operation of actuation mechanism 32 via drive assembly 70. A gear housing 74 can extend forward from drive assembly 70 and provide for a gear drive such as a worm drive gear. Drive assembly 70 and gear housing 74 are together freely rotatable with respect to hinge pin assembly 68. A cover member 76 is connected to right and left side support members 44, 46 which at least partially covers hinge pin assembly 68, drive assembly 70 and motor 72. Right and left hand seat back support members 78, 80 are rotatably connected to individual ones of the right and left side assemblies 40, 42.

Referring to FIG. 4 and again to FIG. 3, drive assembly 70 is rotatable about a longitudinal axis of rotation 82 defined by a hinge pin 84 rotatably received in hinge pin assembly 68. Drive assembly 70 including motor 72 and gear housing 74 rotate about longitudinal axis of rotation 82 from the position shown in FIG. 3 in an upward arc "A" as the leg rest assembly 24 (only partially shown in FIG. 3 as first and second pantograph linkage sets 34, 35 and first and second leg rest support arms 36, 37) is rotated from the stowed position towards an extended position. The drive assembly 70 includes a sliding carriage 85 which is slidably moved either forward or rearward on gear housing 74 by a gear such as a worm drive gear (not shown) of gear housing 74. Sliding carriage 85 is connected using first and second rigid drive links 86, 88 to a drive rod 90. Each of the first and second rigid drive links 86, 88 are fixedly connected to sliding carriage 85 and rotatably connected to drive rod 90 allowing a combination of the rotation of gear housing 74 and drive assembly 70 with respect to longitudinal axis of rotation 82, plus the sliding displacement of sliding carriage 85 along gear housing 74 to rotate and/or translate drive rod 90.

Figure 5:
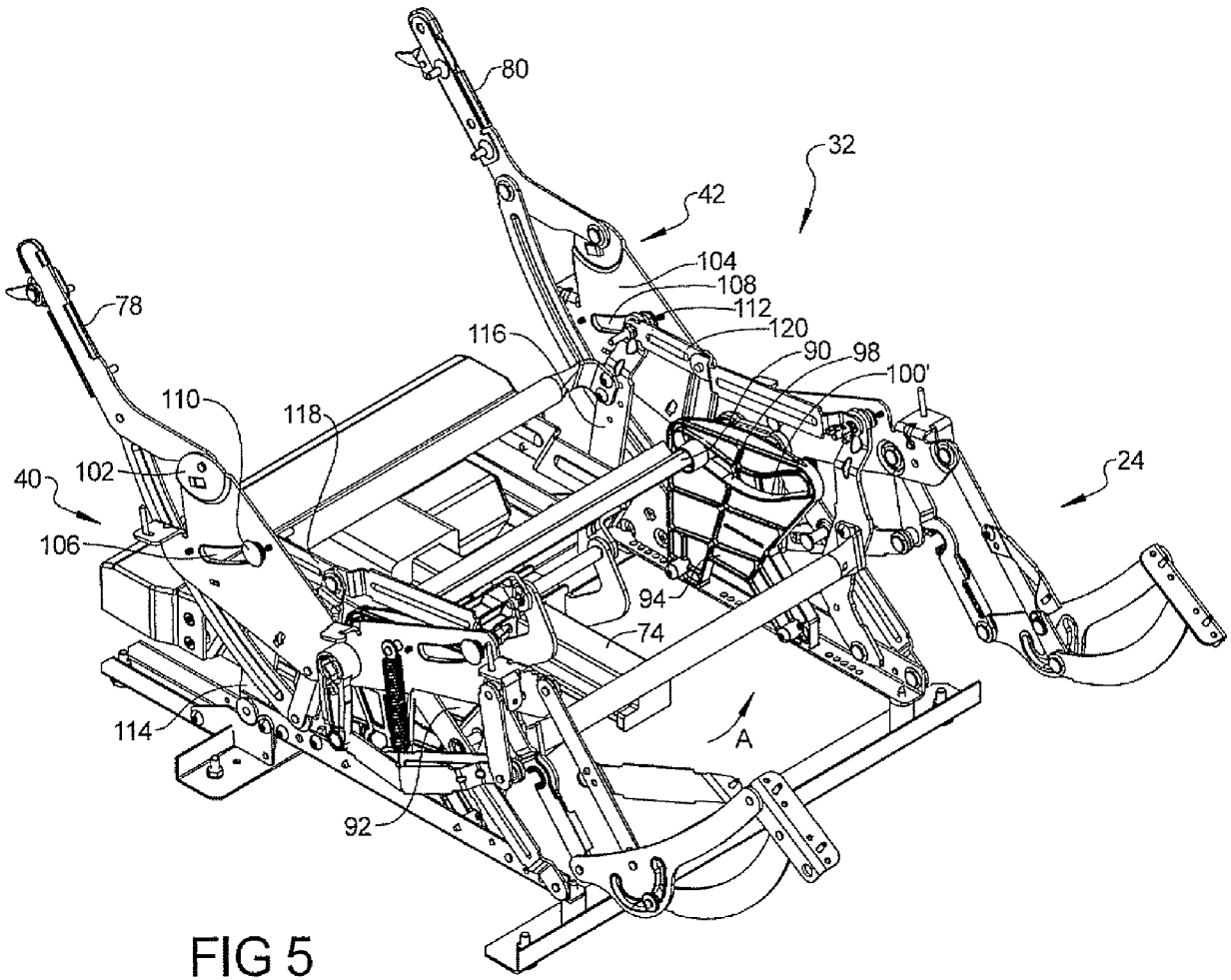
FIG. 5 is a front right perspective view of a actuation mechanism having the leg rest assembly in a released condition.

Referring to FIG. 5, a partially extended position of leg rest assembly 24 is shown. In the leg rest partially extended position, right and left seat back support members 78, 80 are retained in a seat back fully upright position. Gear housing 74 is partially upwardly rotated in the arc of rotation "A". As further visible in FIG. 5, actuation mechanism 32 further includes opposed first and second sequencing plates 92, 94 connected to right and left side assemblies 40, 42 respectively. First and second sequencing plates 92, 94 individually include a first or second curved elongated channels 96, 98 (first curved elongated channel 96 is not clearly visible in this view). Opposed ends of the drive rod 90 are received in and are guided by first and second curved elongated channels 96, 98. According to several embodiments first and second sequencing plates 92, 94 can be created such as a molding of a polymeric material such as polyoxymethylene or from a composite or a metal material. The material selected for first and second sequencing plates 92, 94 provides structural rigidity while also providing for reduced friction during sliding/rotating motion of drive rod 90. Material for the first and second sequencing plates 92, 94 can also be other polymeric materials or can be cast or formed from a metal material such as aluminum. First and second sequencing plates 92, 94 receive opposed ends of drive rod 90 to provide a rotational and displacement passage for drive rod 90. Each first and second curved elongated channel 96, 98 includes a lowest elevated channel position 100, 100' (only channel position 100' is clearly visible in this view).

During the period of extension of leg rest assembly 24 from the retracted to the fully extended position, right and left seat back support members 78, 80 are in the fully upright position. The right and left side assemblies 40, 42 individually include first and second side plates 102, 104, individually including first and second elongated slots 106, 108. First and second pins 110, 112 are slidably received in the first and second elongated slots 106, 108 respectively, and are rotatably connected to first and second rear support links 114, 116 and also rotatably connected to first and second upper connecting links 118, 120. In the fully upright position first and second position pins 110, 112 are positioned furthest forward in their respective first and second elongated slots 106, 108.

Figure 6:
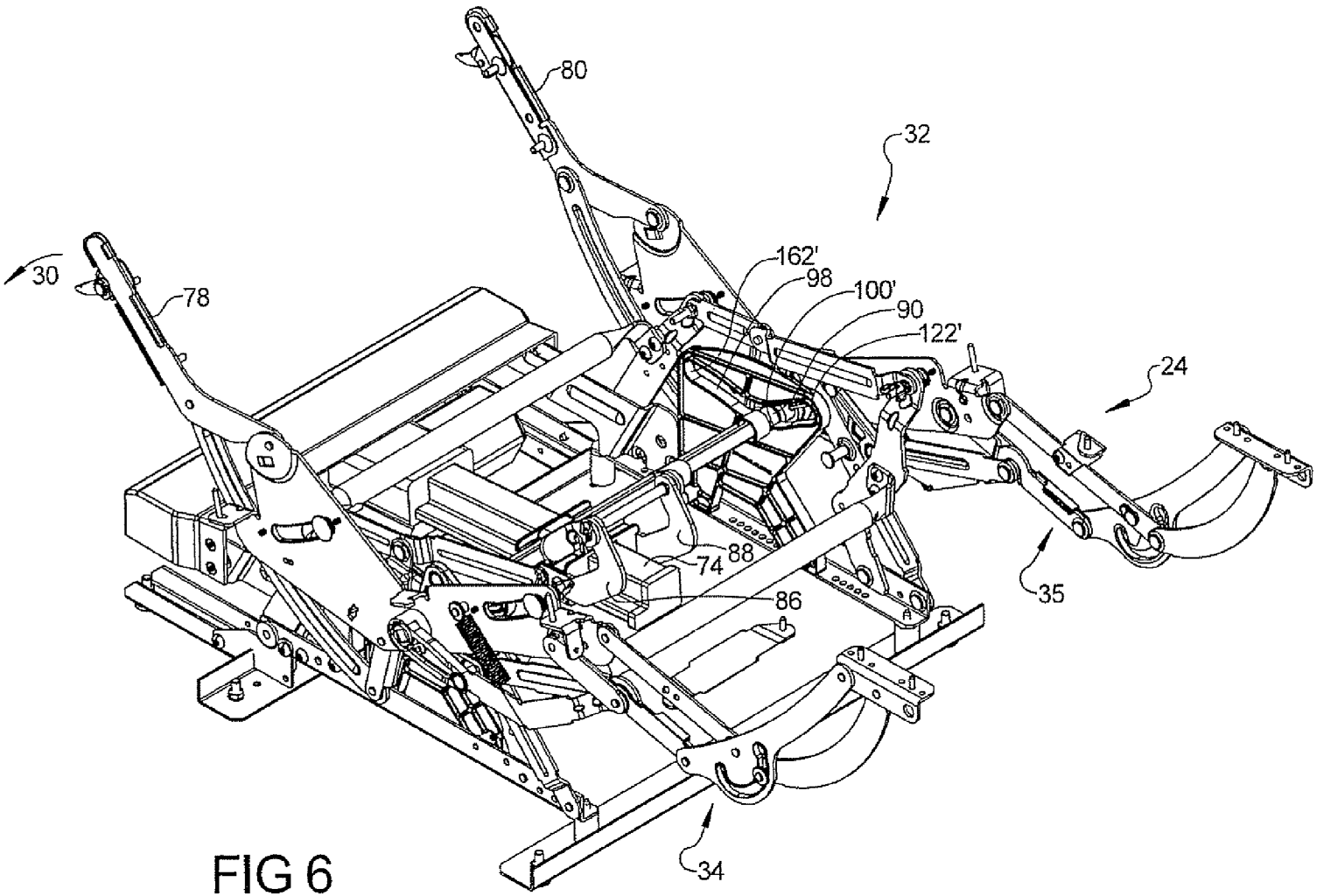
FIG. 6 is a front right perspective view of the actuation mechanism of FIG. 3 further showing the leg rest assembly in a fully extended position.

Referring to FIG. 6, a fully extended position of leg rest assembly 24 and first and second pantograph linkage sets 34, 35 occurs when drive rod 90 reaches the lowest elevation channel position 100, 100' of first and second curved elongated channels 96, 98 (first curved elongated channel 96 is not clearly visible in this view). At this time, axial rotation of drive rod 90 stops. Further upward motion of gear housing 74 causes only translation of drive rod 90 from the lowest elevation channel positions 100, 100' toward first and second forward ends 122, 122' of first and second curved elongated channels 96, 98 (first curved elongated channel 96 including first forward end 122 are not clearly visible in this view). Translation motion of drive rod 90 from the lowest elevation channel positions 100, 100' toward first and second forward ends 122, 122' will thereafter result in rearward rotation of first and second seat back support members 78, 80 about seat back reclining arc of rotation 30.

Figure 7:
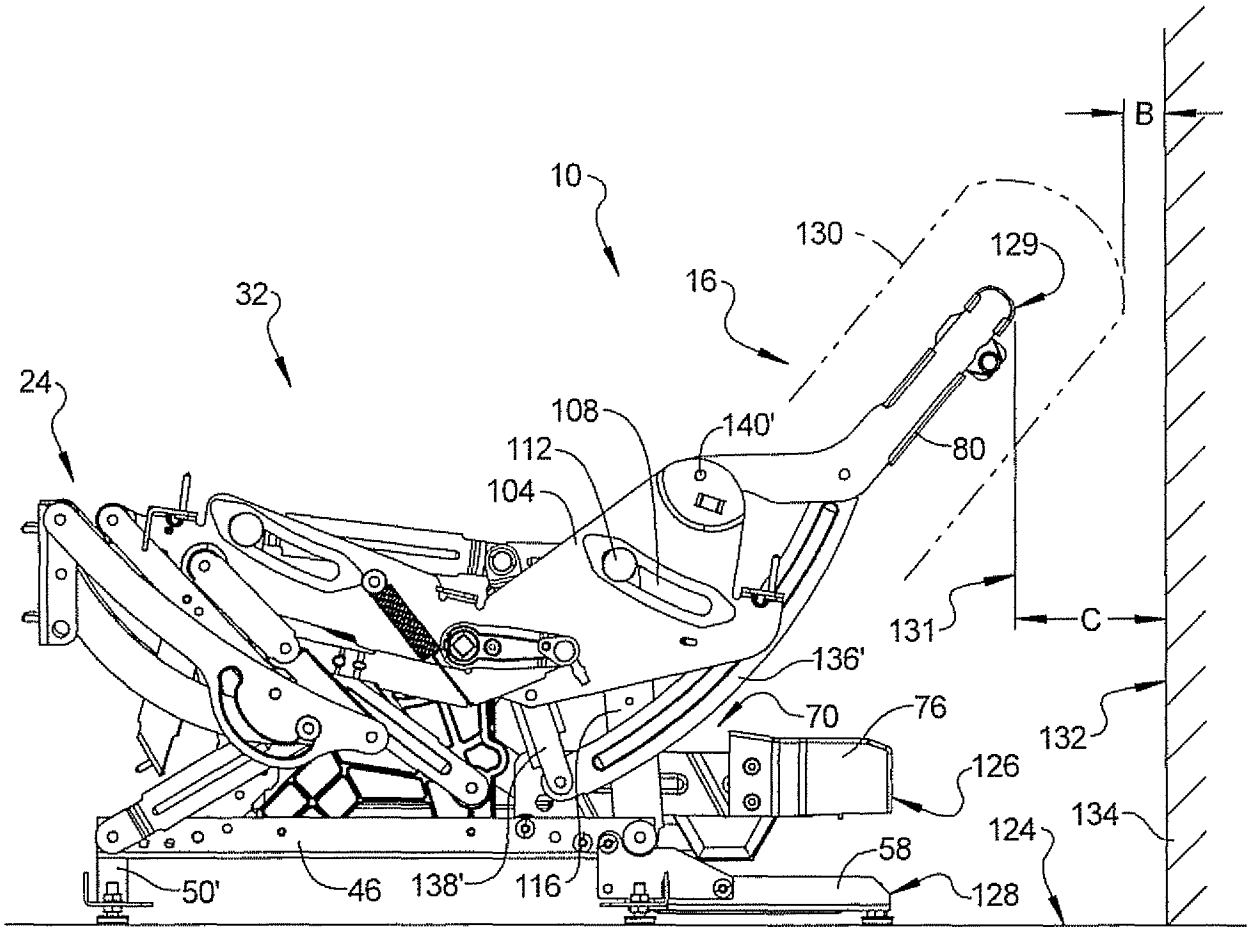
FIG. 7 is a left side elevational view of the actuation mechanism of FIG. 3.

Referring to FIG. 7, the left side of furniture member 10 is shown, however the right side is substantially a mirror image of the left side; therefore, the following discussion applies equally to the corresponding components of the right side.

Furniture member 10 is normally supported on a substantially planar surface 124 such as a floor. Left side support member 46 is preferably oriented parallel to surface 124 and is elevated above surface 124 by both elastic support element 50' and left frame extension 58. According to several embodiments, cover 76 defines the furthest rearward extension of drive assembly 70, such that a rear end face 126 of cover 76 extends approximately equal to a rear edge 128 of left frame extension 58. With leg rest assembly 24 of furniture member 10 positioned in the fully retracted position and seat back member 16 having an outer surface defined by an upholstery layer 130 in the seat back fully upright position, a furniture member-to-wall clearance "B" defines a minimum clearance between furniture member 10 and an outer wall surface 132 of a substantially vertically oriented wall 134. Wall 134 is normally oriented perpendicular to surface 124, but may not be in all circumstances. A seat back support member-to-wall clearance "C" will also define a minimum clearance between left seat back support member 80 and outer wall surface 132.

An arc-shaped link 136' is rotatably connected to left seat back support member 80 at a first end and is rotatably connected to a positioning link 138' at a second end. Positioning link 138' is in turn rotatably connected to second side plate 104. Left seat back support member 80 is rotatably connected to second side plate 104 by a rotational fastener 140' such as a spin rivet. The fully upright position of the seat back member 16 at a point 129 of left seat back support member 80 establishes a vertical plane or rear-most extent 131 of the actuation mechanism 32, the rear-most extent 131 establishing the vertical plane having all portions of the seat back support member 78, 80 (with the exception of point 129) positioned forward of the vertical plane 131 (away from the wall outer surface 132) in any position of furniture member 10. No portion of the seat back support members 78, 80 extend beyond the vertical plane 131 (closer to the wall outer surface 132 with respect to vertical plane 131) in any position of actuation mechanism 32, including the fully upright to fully reclined positions of seat back member 16 or the fully retracted to fully extended positions of leg rest assembly 24. Point 129 is defined as the closest point of the seat back support members 78, 80 with respect to wall outer surface 132. Also, when furniture member 10 is positioned proximate to wall 134, no portion of the upholstered seat back member 16 will extend rearwardly of the position identified by furniture member-to-wall clearance "B", which is controlled by the seat back support member-to-wall clearance "C" of vertical plane 131, for any position of actuation mechanism 32, therefore the rear-most extent 131 also controls a closest point of approach of seat back member 16 to wall outer face 132.

Referring to FIG. 8 and again to FIG. 7, when drive assembly 70 is initially energized, drive rod 90 axially rotates and translates to move leg rest assembly 24 away from the fully retracted position about leg rest extension arc 38. Left seat back support member 80 which is rotatably connected to second side plate 104 by rotational fastener 140' begins to rotate about an arc of rotation 142 with its axis of rotation defined by rotational fastener 140' (clockwise as viewed in FIG. 8) only after leg rest assembly 24 reaches the fully extended position. It is desirable to minimize the approach of left seat back support member 80 toward outer wall surface 132 during this rotation, and for point 129 to be move away from outer wall surface 132 when seat back support member 80 is in the seat back fully retracted position. Therefore, as left seat back support member 80 rotates, arc-shaped link 136' is displaced by rotating positioning link 138'. Positioning link 138' is itself rotatably connected to second side plate 104 by a rotational fastener 144'. Positioning link 138' therefore rotates about an arc of rotation 146. At the same time, second rear support link 116 which is rotatably connected to left side support member 46 by a rotational fastener 148' begins to rotate forwardly (counterclockwise as viewed in FIG. 8) with respect to rotational fastener 148'.

Figure 8:
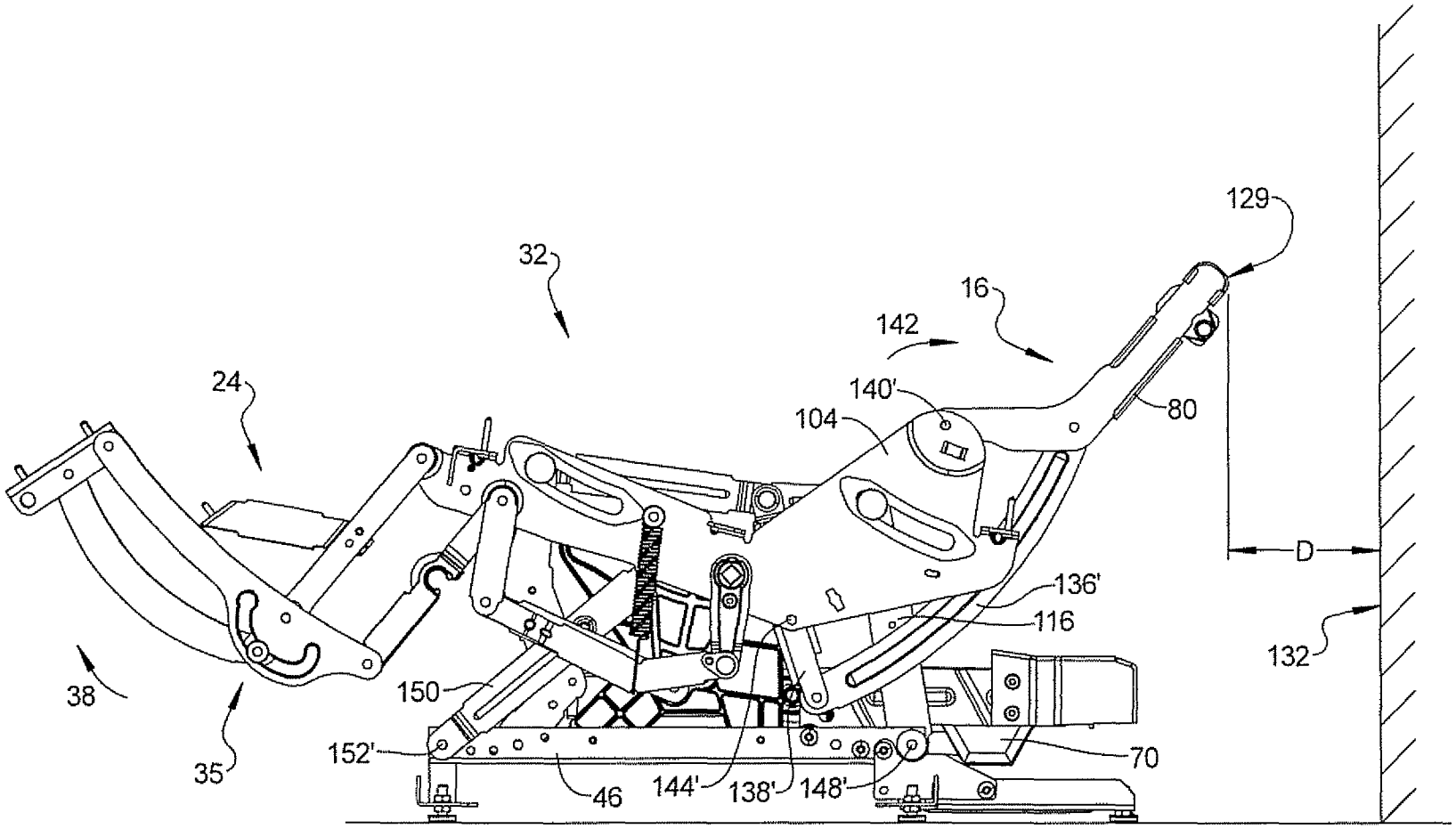
FIG. 8 is a left side elevational view of the actuation mechanism of FIG. 5.

Concomitant with forward rotation of second rear support link 116, a left front support link 150 rotatably connected to left side support member 46 by a rotational fastener 152' and to second side plate 104 also rotates forwardly (counterclockwise as viewed in FIG. 8 with respect to rotational fastener 152'). The tendency of left seat back support member 80 to approach outer wall surface 132 during its arc of rotation 142 about rotational fastener 140' is reduced by the combined rotation of arc-shaped link 136', second rear support link 116, and left front support link 150. The combined rotation of arc-shaped link 136', second rear support link 116, and left front support link 150 moves second side plate 104 forward such that a resulting seat back member to wall clearance "D" in the leg rest assembly 24 release position is greater than seat back member to wall clearance "C" when the leg rest assembly 24 is in the fully retracted position.

Figure 9:
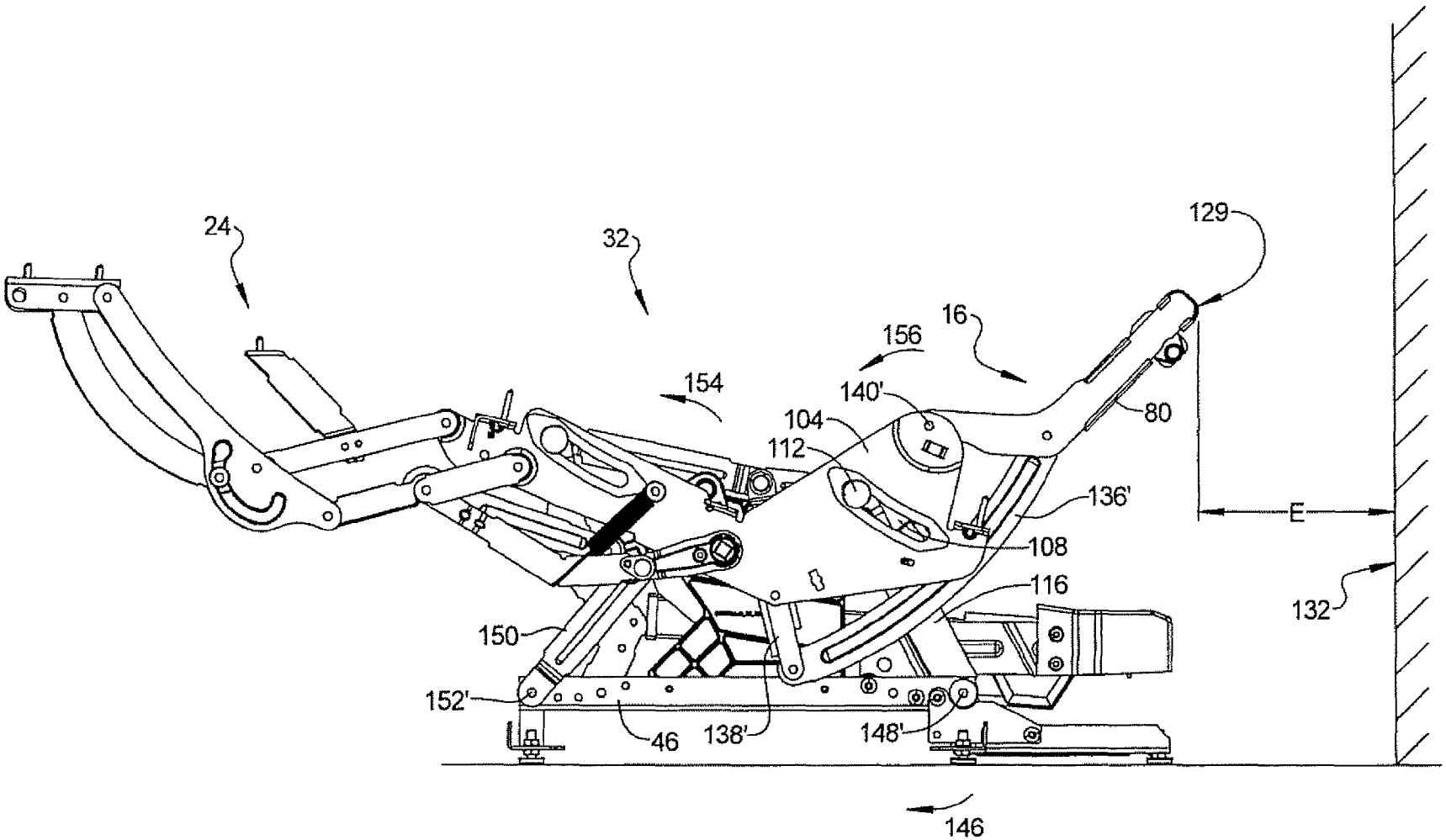
FIG. 9 is a left side elevational view of the actuation mechanism of FIG. 6.

Referring to FIG. 9 and again to FIGS. 7 and 8, leg rest assembly 24 reaches the fully extended position by continued rotation of arc-shaped link 136', second rear support link 116, and left front support link 150 as previously described such that a forward end of second side plate 104 moves generally forward and upward about an arc of rotation 154 determined with respect to rotational fastener 152'. At the same time, a rearward end of second side plate 104 moves generally forward and downward about an arc of rotation 156 defined with respect to rotational fastener 148'. As previously noted, seat back member 16 is retained in the fully upright position during leg rest extension having second pin 112 positioned at or proximate to the forward end of second elongated slot 108. The fully upright position is therefore established when the second pin 112 is positioned at or proximate to the forward end of second elongated slot 108 (and similar positioning of first pin 110 with respect to first elongated slot 106 shown and described with respect to FIG. 5). A limited rearward rotation of seat back member 16 can occur during leg rest assembly extension due to the motion of second side plate 104. When leg rest assembly 24 reaches the fully extended position, a clearance "E" is created between point 129 of left seat back support member 80 and outer wall surface 132 which is greater than clearances "D" and/or "C".

Referring to FIG. 10 and again to FIGS. 6 and 7, leg rest assembly 24 is positioned in the leg rest fully retracted position when drive rod 90 contacts or is in close proximity to rear facing end walls 162, 162' of first and second curved elongated channels 96, 98 (only rear facing wall 162' of second curved elongated channel 98 is visible in the view of FIG. 6). After leg rest assembly 24 reaches the fully extended position, subsequent forward translation of drive rod 90 within first and second curved elongated channels 96, 98 from the lowest elevation channel position 100 continues until drive rod 90 is positioned proximate to or contacts first and second channel forward end walls 122, 122' (first channel end wall 122 is not clearly visible in FIG. 6).

Translation motion of drive rod 90 from the lowest elevation channel position 100 until positioned proximate to or in contact with second channel end wall 122, 122' generates a continuous reclining rotation of right and left seat back support members 78, 80 in a seat back reclining arc of rotation 30. Continued rotation of arc-shaped link 136', second rear support link 116, and left front support link 150 as previously described with respect to arc of rotation 154 and arc of rotation 156 continues, however this continued rotation causes second pin 112 to displace away from a forward facing end wall 158' of second elongated slot 108 until second pin 112 either contacts or proximately approaches a rear facing end wall 160' of second elongated slot 108, establishing the fully reclined position of seat back member 16. Furniture member-to-wall clearance "B" as shown in FIG. 7 will normally be at a minimum dimension when the upholstery layer 130 reaches its rear-most extension, which can occur at or near the seat back fully upright position.

The portions of actuation mechanism 32 connected by first and second rear support links 114, 116 and right and left front support links 150, 150' to right and left side support members 44, 46, therefore, move forward in an overall forward direction "F" with respect to right and left side support members 44, 46 during extension of leg rest assembly 24 and/or rotation of seat back member 16 toward the seat back fully reclined position to increase clearance with respect to outer wall surface 132. Right and left side support members 44, 46 remain substantially stationary during all movements of actuation mechanism 32. In the seat back fully reclined position, a maximum seat back member to wall clearance "G" is defined. Also in the seat back fully reclined position rear end face 126 of cover 76 can define the closest point of approach between actuation mechanism 32 and outer wall surface 132.

Referring again to FIGS. 4-10, to return from the fully extended position of leg rest assembly 24 to the fully retracted position, actuation mechanism 32 is operated in an opposite manner. Initially, with drive rod 90 in contact with first and second channel end walls 122, 122' downward rotation of drive assembly 70 and gear housing 74 with respect to longitudinal axis of rotation 82 of hinge pin assembly 68 results in a rearward motion of first and second rigid drive links 86, 88, which rearwardly retracts drive rod 90 in first and second curved elongated channels 96, 98 until drive rod 90 once again reaches the lowest elevation channel position 100, 100'. From this position, combined axial rotation and rearward translation of drive rod 90 again occurs from further downward rotation of drive assembly 70 and gear housing 74 with respect to longitudinal axis of rotation 82 of hinge pin assembly 68, which rotates leg rest assembly 24 toward the retracted position. It is further noted that first and second curved elongated channels 96, 98 define a generally V-shape configuration having the lowest elevation channel position 100, 100' downwardly positioned with respect to each of an elongated channel rear end wall 162, 162' and the elongated channel forward end wall 122, 122' positions.

A wall proximity furniture member 10 having an electrically powered actuation mechanism 32, therefore, includes a frame 48 having an actuation mechanism 32 connected to the frame 48. The actuation mechanism 32 includes an extendable and retractable leg rest assembly 24 and an independently rotatable seat back member 16. An electrically powered drive assembly 70 operates to move the leg rest assembly 24 between retracted and extended positions and to separately rotate the seat back member 16 between upright and fully reclined positions. An arc-shaped link 136, 136' permits the seat back member 16 to rotatably displace between fully upright and fully reclined positions inclusive with the seat back member 16 moving forward and away from a position of the seat back member 16 when positioned in the fully upright position such that the fully upright position of the seat back member 16 establishes a rear-most extent 131 of the actuation mechanism 32.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. An electrically operated wall proximity furniture member, comprising:

a frame;

an actuation mechanism connected to the frame including at least one rotatable seat back support member and an electrically powered drive assembly operating to rotate the seat back support member between fully upright and fully reclined positions inclusive;

a link displacing the seat back support member between the fully upright and fully reclined positions inclusive with the seat back support member moved substantially forward from the fully upright position to the fully reclined position such that the fully upright position defines a rear-most extent of the seat back support member;

an extendable and retractable leg rest assembly, the electrically powered drive assembly operating to move the leg rest assembly between fully retracted and fully extended positions inclusive; and a drive rod translatable in a forward direction by the drive assembly to move the seat back support member from the fully upright to the fully reclined position, the seat back support member in the fully extended position of the leg rest assembly being positioned forward of the position of the seat back support member in the seat back fully upright position;

wherein the actuation mechanism includes opposed sequencing plates each having an elongated channel individually receiving one end of the drive rod, the drive rod being both axially rotated and translated within the elongated channel of each of the sequencing plates during extension and retraction of the leg rest assembly and only translated during seat back support member movement.

2. The electrically operated wall proximity furniture member of claim 1, wherein the actuation mechanism includes first and second end walls of the elongated channel of each sequencing plate and a lowest elevation channel position positioned elevationally below both the first and second opposed end walls, the drive rod when positioned in the lowest elevation channel position defining the fully extended position.

3. An electrically operated wall proximity furniture member, comprising:

a frame;

an actuation mechanism connected to the frame including at least one rotatable seat back support member and an electrically powered drive assembly operating to rotate the seat back support member between fully upright and fully reclined positions inclusive; and a link displacing the seat back support member between the fully upright and fully reclined positions inclusive with the seat back support member moved substantially forward from the fully upright position to the fully reclined position such that the fully upright position defines a rear-most extent of the seat back support member;

wherein the actuation mechanism further includes:

a drive rod operating to displace an extendable and retractable leg rest assembly, the electrically powered drive assembly operating to axially rotate and translate the leg rest assembly between fully retracted and fully extended positions;

opposed sequencing plates each having an elongated channel including first and second end walls and a lowest elevation channel position positioned between the first and second end walls;

the drive rod having ends received in the elongated channels of the opposed sequencing plates and being positioned proximate to the first end walls with the leg rest assembly in the fully retracted position; and the leg rest assembly reaching the fully extended position when the drive rod is positioned at the lowest elevation channel positions.

4. An electrically operated wall proximity furniture member, comprising:

a frame;

an actuation mechanism connected to the frame including at least one rotatable seat back support member and an electrically powered drive assembly operating to rotate the seat back support member between fully upright and fully reclined positions inclusive;

a link displacing the seat back support member between the fully upright and fully reclined positions inclusive with the seat back support member moved substantially forward from the fully upright position to the fully reclined position such that the fully upright position defines a rear-most extent of the seat back support member;

a drive rod having opposed ends each moving in an elongated channel between a first channel end wall to a lowest elevation channel position in response to motion of the drive assembly; and the at least one seat back support member including first and second seat back support members rotatably positioned between the fully upright position and the fully reclined position inclusive, the first and second seat back support members being positioned in the fully upright position until the drive rod reaches the lowest elevation channel position after which further actuation of the drive assembly displaces the drive rod without axial rotation from the lowest elevation channel position toward a second channel end wall elevated above the lowest elevation channel position, the first and second seat back support members positioned in the fully reclined position when the drive rod is positioned proximate to or in contact with the second end wall.

5. An electrically operated wall proximity furniture member, comprising:

a frame;

an actuation mechanism rotatably connected to the frame, the actuation mechanism including first and second rotatable seat back support members positioned within a seat back member having an outer surface defined by an upholstery layer and an electrically powered drive assembly operating to rotate both the seat back support members and the seat back member between fully upright and fully reclined positions inclusive; and a point of the seat back member when positioned in the fully upright position defining a rear-most extent of the seat back member between the fully upright and fully reclined positions, the rear-most extent defining a vertical plane acting as a closest point of approach of the seat back member with respect to a wall outer surface, wherein all portions of the seat back member including the upholstery layer are positioned forward of the vertical plane and further away from the wall outer surface in the fully reclined position of the seat back member.

6. The electrically operated wall proximity furniture member of claim 5, further including a pin positioned in an elongated slot and in contact with a forward facing first end of the elongated slot defining the fully upright position, the pin displacing to a rear facing second end of the elongated slot defining the fully reclined position when the seat back support members are rotated from the fully upright position to the fully reclined position.

7. The electrically operated wall proximity furniture member of claim 5, wherein the frame further includes:

right and left support members;

front and rear cross members; and a plurality of elastic support elements disposed between ends of the right and left support members and the front and rear cross members.

8. The electrically operated wall proximity furniture member of claim 5, wherein the actuation mechanism further includes an extendable and retractable leg rest assembly, the electrically powered drive assembly further operating to move the leg rest assembly between retracted and extended positions inclusive.

9. The electrically operated wall proximity furniture member of claim 5, wherein the actuation mechanism includes:

a drive rod rotatably connected through at least one linkage to the seat back support members;

opposed sequencing plates each having an elongated channel individually receiving one end of the drive rod, the drive rod being both axially rotated and translated within the elongated channel of each of the sequencing plates during extension and retraction of the leg rest assembly.

10. An electrically operated wall proximity furniture member, comprising:

a frame;

an actuation mechanism rotatably connected to the frame, the actuation mechanism including an extendable and retractable leg rest assembly and first and second rotatable seat back support members oriented to face a wall outer surface, the seat back support members positioned within a seat back member having an outer surface defined by an upholstery layer;

an electrically powered drive assembly operating to move the leg rest assembly between retracted and extended positions inclusive and to further rotate the seat back support members and thereby the seat back member between fully upright and fully reclined positions inclusive; and a rear-most point of the seat back member when positioned in the fully upright position positioned at a rear-most extent of the seat back member, the rear-most extent defining a vertical plane spaced from the wall outer surface having no portion of the seat back member extending beyond the vertical plane, the rear-most point of the seat back member including the upholstery layer when repositioned to the fully reclined position being further forward than in the fully upright position.

11. The electrically operated wall proximity furniture member of claim 10, wherein the drive assembly further includes an electric motor, the electric motor and the drive assembly both co-axially rotatable about an axis of rotation.

12. The electrically operated wall proximity furniture member of claim 11, wherein the drive assembly further includes a gear drive assembly co-rotatable with the electric motor.

13. The electrically operated wall proximity furniture member of claim 10, wherein the frame includes:

right and left support members each having an end;

front and rear cross members oriented substantially transverse to the right and left support members; and a tubular shaped elastic support element fastenably connected in a substantially vertical orientation between individual ones of the ends of the right and left support members and the front and rear cross members.

14. The electrically operated wall proximity furniture member of claim 10, wherein the frame includes first and second extension members and wherein the drive assembly is at least partially protected by a cover, the first and second extension members and the cover being positioned forward of the rear-most extent of the seat back support members in the seat back fully upright position.

* * * * *